United States Patent [19]

Schuelein et al.

[11] 4,107,809

[45] Aug. 22, 1978

[54] CORNER SWEEPING BRUSH DISPOSED ON A FLOOR SWEEPER

[75] Inventors: Rolf G. Schuelein, Singhofen; Rainer Friedrich, Nassau, Lahn, both of Germany

[73] Assignee: Leifheit International Guenter Leifheit GmbH, Nassau, Lahn, Germany

[21] Appl. No.: 791,985

[22] Filed: Apr. 28, 1977

[30] Foreign Application Priority Data

May 17, 1976 [DE] Fed. Rep. of Germany ..... 2621871

[51] Int. Cl.[2] ..... A47L 11/33

[52] U.S. Cl. ..... 15/42

[58] Field of Search ..... 15/42, 87

[56] References Cited

U.S. PATENT DOCUMENTS 3,978,539 9/1976 Yonkers ..... 15/42

*Primary Examiner*—Edward L. Roberts

*Attorney, Agent, or Firm*—Michael J. Striker

[57] ABSTRACT

A floor sweeper is provided. The sweeper includes a frame having a corner portion. A hub member is mounted at the corner portion for rotation about an upright axis which is inclined to the horizontal. The hub has a circumferential side face and an underside with faces toward a surface to be swept. An annulus of bristles projects from the sideface of the hub member. The bristles have free end portions projecting downwardly beyond the underside so that increments of the annulus consecutively contact the surface to be swept because of the inclination of the axis. An annulus of radially extending teeth are connected to the underside of the hub member from which they extend downwardly to thereby engage the surface to be swept so as to rotate the hub member.

10 Claims, 3 Drawing Figures

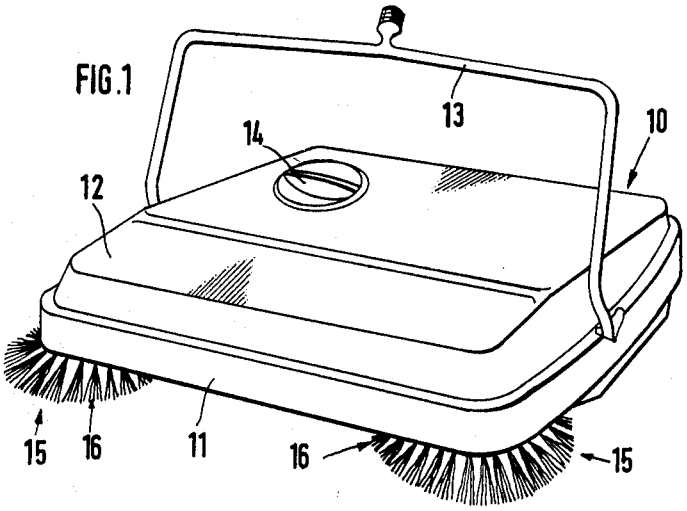
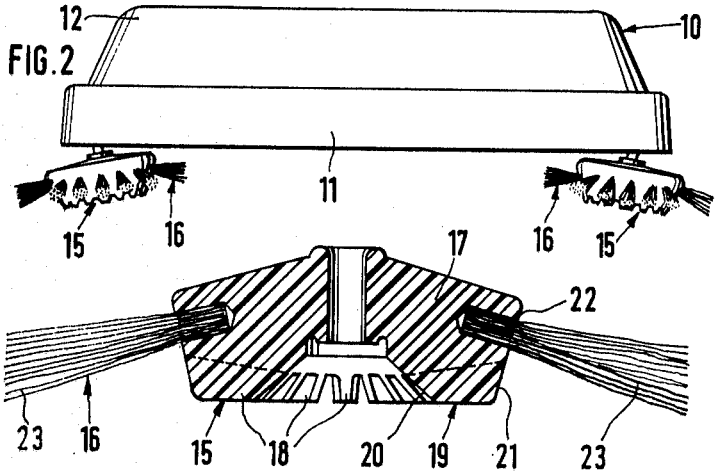
FIG.3

CORNER SWEEPING BRUSH DISPOSED ON A FLOOR SWEEPER

BACKGROUND OF THE INVENTION

The invention relates to a corner brush arranged on a floor sweeper and rotating around an upwardly directed or erect axis. The body of the corner brush has a bristle annulus projecting beneath the proximate side wall of the floor sweeper and the body is oriented outwardly and below relative to the floor sweeper. The erect axis of rotation is inclined such that a part of the circumferential area of the prone bristle annulus is inclined in such a manner that a tangent to this part of the circumferential area is normal to the direction of movement of the sweeper.

Various sweeping devices of this type have already been proposed. The corner brushes of these devices are driven into rotation by means of a particular wheel mounted in the housing. With back and forth movement of the floor sweeper, the wheel is turned on the floor and is therefore set into rotation. This rotation is transferred to the corner brush so that the corner brush is forced into rotation as the floor sweeper moves back and forth. The rotation of the corner brushes is dependent on the movement of the wheels driving the corner brushes and consequently is dependent on the course of movement of the sweeping device as a whole. The wheel therefore has an axis which has a friction wheel at its free end. The friction wheel is connected to the upper side of the corner brush body. This type of prior art floor sweeper is disadvantageous because of the high cost of providing this drive since a special wheel and a gearing are required.

SUMMARY OF THE INVENTION

Accordingly, it is a general object of the present invention to avoid this disadvantage of the prior art floor sweepers.

More particularly, it is an object of the present invention to provide a floor sweeper with a corner brush which drives itself and therefore assures an inexpensive production of the inventive floor sweeper.

To attain this goal, the corner brush has on its underside an annulus of radially extending teeth. A tangent to a horizontal part of the circumferential area defined by this annulus is normal to the direction of movement of the sweeper.

This part of the circumferential area of the teeth, which faces the adjacent side wall of the floor sweepr, rests on the floor which is to be cleaned. The teeth of the inventive corner brush body are used in a simple manner for rotating the corner brush; because of the tilting orientation of the brush, the annulus of the radially extending teeth has part of its circumferential area lying against, for example, a carpet and the teeth are forced into the carpet. When the sweeper is moved, the combination of this motion plus the resistance of, for example, the carpet causes the radially extending teeth to turn. Consequently, the attached corner brush body is set into rotation.

Advantageously, the annulus of the radially extending teeth extends up to the outer edge of the disk-shaped corner brush body. In this way, the turning of the annulus of the radially extending teeth takes place on the floor with a relatively long lever arm.

Advantageously, the free front surfaces of the radially extending teeth are arranged in a plane. This is a simple way to avoid awkward protrusions.

In an appropriate manner the radially extending teeth can increase in height in an outward direction. By this increase, the outermost areas of the teeth can engage the carpet at their longest parts.

The radially extending teeth can be suitably increased in width in an outward direction. By this broadening, the outer ends of the teeth are reinforced by an increased strength.

Advantageously, the radially extending teeth are increased in width towards the base of the teeth (the base of the teeth is that side connecting the teeth to the corner brush body). In this way, the teeths' free front surfaces engaging the carpet are narrower than the base and can then easily engage the carpet.

The inner ends of the radially extending teeth can be shaped with conical cuts which incline inwardly from the free front surfaces of the radially extending teeth towards the base of the teeth. Similarly, the outer ends of the radially extending teeth can be formed with conical sections inclining sustantially towards the base of the teeth from the free front surfaces. In this way, the free front surfaces are relatively small and so a trouble-free engagement of the teeth into the carpet is rendered possible.

The conical sections forming the outer ends of the radially extending teeth can pass straight-lined into the outer surface of the corner brush body. In this case, the corner brush body similarly has a conically shaped outer surface.

The bristle annulus which is oriented outwardly and below relative to the sweeper is part in the conical surface of the corner brush body. The bristle annulus can be formed from a rotating series of bristle tufts.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is an overhead view of the inventive corner brushes provided on a floor sweeper;

FIG. 2 is a front view of the floor sweeper; and

FIG. 3 shows the inventive corner brush in a magnified cross-section.

DETAILED DESCRIPTION OF THE PREFERRED EMBODIMENT

FIG. 1 illustrates a floor sweeper having a housing 10 which is firmly connected in a known manner, with an enclosing frame 11. The apparatus also has an upper part 12 closing the top side. The frame 11 serves to receive a bracket 13. An unillustrated shaft-like handle is attached to bracket 13 for movement of the floor sweeper over the floor. The frame 11 serves on the inner side of the apparatus for supporting the sweeping brushes, as well as for moving the floor sweeper over a floor surface and for driving the wheels serving the sweeping brushes. An unillustrated roller brush is provided with the floor sweeper for receiving the dirt from the floor.

The roller brush extends transverse to the direction of movement and is pivoted. The roller brush can be vertically adjusted by means of the adjustable member 14.

The unillustrated drive wheels are frictionally correlated for rotation of the roller brush against the floor. These drive wheels are arranged in pairs on both sides of the enlarged diameter of the ends of the roller brush in the frame 11. Dirt collectors are provided on both sides of the roller; dirt taken up from the floor is brought into the dirt collectors. Since the dirt collectors are located respectively in front of and in back of the roller brush relative to the direction of movement of the floor sweeper, the roller brush driven by the wheels can even commence a reversal of the direction of rotation with the customary back and forth movement over the floor. Then the dirt is continually sent, according to the direction of rotation, into one of the two dirt collectors.

Since the roller brush can effectively sweep only up to a certain distance from the side wall area of the floor sweeper, corner brushes 15 are provided. With the aid of corner brushes 15 side areas of a floor lying beyond the effective operational zone of the roller brush can be swept so that the floor can be completely cleaned along recesses, and walls as well as corners.

In the illustrated embodiment, a corner brush 15 is disposed at each of the corner areas of the sweeping machine in such a manner that the corner brush 15 is rotatable around an essentially erect axis and the corner brush 15 with its bristle annulus 16 overlaps both the effective operating zone of the roller brush and the side and front wall area of the housing.

The corner brushes rotate around an upwardly directed axis. The corner brush body 15 has a bristle annulus 16 jutting below the adjacent side wall of the floor sweeper, the annulus 16 being oriented outwardly and under the floor sweeper. The upwardly directed axis of rotation is inclined about 7.5°, preferably so that the bristle annulus 16 of the corner brush 15 rests on the floor such that a tangent to a part of the annulus can be normal to the direction of movement of the floor sweeper.

For efficient rotating, the corner brush 15 has on its underside an annulus of radially extending teeth 18. The annulus is inclined in such a manner that a tangent to the annulus on the periphery of the bristles can be normal to the direction of movement of the sweeper. Preferably, the annulus is upwardly inclined in the direction extending inwardly towards the center of the frame 11 in such a manner that the annulus extends from a position beyond or outwardly of the frame to a position within the frame 11. The annulus is advantageously progressively upwardly inclined in the inward direction so that the most outward portion of the annulus beyond the frame 11 is in contact with the surface to be swept while the most inward portion is disengaged therefrom.

The radially extending teeth 18 are pressed into the carpet so that the corner brush body 17 and therefore the corner brush 15 is reliably set into rotation. In FIG. 3, in which the corner brush 15 is shown, in an enlarged view, an embodiment having fewer radially extending teeth is illustrated for sake of simplicity. In practice, however, perhaps twenty radially extending teeth 18 are distributed on the corner brush body 17.

The radially extending teeth 18 extend to the outer edge of the disk-shaped corner brush body 17. The free front surfaces 19 of the radially extending teeth are arranged in a plane. The teeth 18 are shaped in such a manner that the radially extending teeth increase in height in an outward direction. Moreover, the thickness of the radially extending teeth increases outwardly. In addition, the thickness of the teeth 18 increases in the direction towards the base of the teeth 18.

The inner end of the radially extending teeth 18 is shaped with a conical surface cut 20 which inclines inwardly from the free front surface 19 to the base of the teeth. The outer ends of the radially extending teeth 18 are similarly formed with a conical surface cut 21 which inclines outwardly from the free front surface 19 towards the base of the teeth 18. As a result of this shaping of the radially extending teeth 18, the free front faces 19 are relatively short so therefore they can easily be pressed into the carpet.

The conical surface cut 21 forming the outer end of the radially extending teeth 18 extends as a straight line, into the outer surface 22 of the corner brush body 17. The bristle annulus 16, oriented outwardly and below of the sweeper, is inserted in the conical surface 22 of the corner brush body 17. The bristle annulus 16 is formed from a rotating series of bristle tufts 23; twenty bristle tufts 23 are distributed on the surface 22 of the corner brush body 17.

The teeth 18 extending radially to the annulus of the bristles are arranged within the bristle annulus 16 so that the relative motion is conveyed to the bristle annulus 16 by means of the rolling on the floor of the annulus of the radially extending teeth; therefore, a sweeping action is achieved.

It will be understood that each of the elements described above, or two or more together, may also find a useful application in other types of constructions differing from the types described above.

While the invention has been illustrated and described as embodied in a corner body brush disposed on a floor sweeper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A floor sweeper, comprising a frame having a corner portion; a hub member mounted at said corner portion for rotation about an upright axis which is inclined to the horizontal, said hub member having a circumferential sideface and an underside facing toward a surface to be swept; an annulus of bristles on said sideface of said hub member and having free end portions which project downwardly beyond said underside so that, due to the inclination of said axis, only the bristles of consecutive increments of said annulus are in contact with the surface to be swept; and an annulus of radially extending teeth on said underside of said hub member and extending downwardly therefrom for engaging the surface to be swept so as to rotate said hub member.

2. The sweeper defined in claim 1, the axis of said hub member being tilted in such a manner that said hub member tilts downwardly in the direction outwardly from the center of the frame; said annulus of bristles being arranged in such a manner that bristles furthest from the center of the frame are engageable with a surface to be swept while bristles closest to the center of the frame are then disengaged from the surface; and said annulus of teeth being arranged in such a manner that at least a portion of said teeth are engageable with the surface to be swept.

3. The sweeper defined in claim 2, said teeth being engageable with generally upright projections in the surface so as to thereby be detained from forward movement by such projections as said frame is pushed forward, whereby said teeth and said hub member rotate about the axis.

4. The sweeper defined in claim 1, said teeth each having a bottom edge formed by a free end surface, each of said bottom edges extending upwardly from a common plane.

5. The sweeper defined in claim 1, said teeth increasing in height in directions radially outwardly from the axis of said hub member.

6. The sweeper defined in claim 1, said teeth increasing in width in directions radially outwardly from the axis of said hub member.

7. The sweeper defined in claim 1, said teeth extending along the underside of said hub member to a position flush with the sideface of said hub member.

8. The sweeper defined in claim 1, said teeth having a top surface connected to said hub member, at least a portion of the top surface being conical and downwardly inclined towards the axis of said hub member, the underside of said hub member being reciprocally conically shaped so as to fit against the conical portion of the top surface of said teeth.

9. The sweeper defined in claim 1, said teeth decreasing in width in direction downwardly from the underside of said hub member, whereby each tooth is narrower at its bottom than its top so that the tooth more easily penetrates a carpet surface.

10. The sweeper defined in claim 1, the axis being inclined about 7.5° relative to the vertical, and said teeth being kept free from contact with the bristles.

* * * * *